US008584855B2

(12) United States Patent
Ito et al.

(10) Patent No.: US 8,584,855 B2
(45) Date of Patent: Nov. 19, 2013

(54) PACKAGING POUCH FOR ABSORBENT ARTICLE

(75) Inventors: Shigeo Ito, Kagawa (JP); Yasuhiro Iwabu, Kagawa (JP); Tatsuo Takashima, Kagawa (JP); Akira Ono, Kagawa (JP)

(73) Assignee: Cosmotec Corporation, Kagawa (JP)

( * ) Notice: Subject to any disclaimer, the term of this patent is extended or adjusted under 35 U.S.C. 154(b) by 0 days.

(21) Appl. No.: 13/544,109

(22) Filed: Jul. 9, 2012

(65) Prior Publication Data

US 2013/0008824 A1 Jan. 10, 2013

(30) Foreign Application Priority Data

Jul. 8, 2011 (JP) ..... 2011-152166

(51) Int. Cl.
*B65D 65/28* (2006.01)
*B65D 33/06* (2006.01)
*B65D 75/62* (2006.01)

(52) U.S. Cl.
USPC ..... 206/494; 206/440; 383/207

(58) Field of Classification Search
USPC ..... 206/494, 440, 581, 812, 497, 525; 383/207, 200, 8, 11, 16, 21, 6; 229/87.05
See application file for complete search history.

(56) References Cited

U.S. PATENT DOCUMENTS 3,568,918 A * 3/1971 Blomqvist ..... 383/109
4,573,203 A * 2/1986 Peppiatt ..... 383/29
4,854,733 A * 8/1989 Schwinn ..... 383/29
4,890,934 A * 1/1990 Feaver et al. ..... 383/10
5,033,868 A * 7/1991 Peppiatt ..... 383/29
5,036,978 A * 8/1991 Frank et al. ..... 206/494
5,059,034 A * 10/1991 Schulz et al. ..... 383/21
5,112,138 A * 5/1992 Peppiatt ..... 383/29
5,121,995 A * 6/1992 Newman et al. ..... 383/29
5,158,368 A * 10/1992 Lichtwardt et al. ..... 383/21
5,282,687 A * 2/1994 Yee ..... 383/25
5,380,094 A * 1/1995 Schmidt et al. ..... 383/209
5,514,067 A * 5/1996 Schmidt et al. ..... 493/196
5,722,773 A * 3/1998 Conrad ..... 383/10
5,722,774 A * 3/1998 Hartz ..... 383/207
6,095,686 A * 8/2000 Mohrmann ..... 383/8
2006/0096880 A1* 5/2006 Zander et al. ..... 206/440
2007/0151887 A1* 7/2007 Clark et al. ..... 206/494
2012/0325716 A1* 12/2012 Evenson et al. ..... 206/494

FOREIGN PATENT DOCUMENTS

JP 10-258848 9/1998

* cited by examiner

*Primary Examiner* — Steven A. Reynolds
(74) *Attorney, Agent, or Firm* — Brinks Gilson & Lione

(57) ABSTRACT

A packaging pouch for packaging an absorbent article has a front, back and side faces. The side faces are folded between the front and back faces. The packaging pouch is rectangular in use. A sealing portion expanding in a transverse direction around the upper end of the packaging pouch, a side face portion that forms the side face of the package, and a top portion that forms the top face of the package by positioning between the sealing portion and the side face portion are formed. Moreover, perforations are formed in the top portion along a reference line extending in the transverse direction from one side edge of the packaging pouch to the other side edge of the packaging pouch. Handle members extending in the transverse direction from around one to the other side edge and are attached to the front back faces in the top portion below the perforations.

10 Claims, 9 Drawing Sheets

PACKAGING POUCH FOR ABSORBENT ARTICLE

BACKGROUND OF THE INVENTION

1. Field of the Invention

The present invention relates to a packaging pouch for an absorbent article.

2. Related Art

A packaging pouch made of plastic film is known that is for packaging paper diapers and other absorbent articles. An outer package formed by packaging an absorbent article in the packaging pouch has a rectangular shape. The packaging pouch is provided with a front face, a back face and a pair of side faces connected to the front face and the back face. The side faces are folded towards the inside and are arranged between the front face and the back face. A carrying strap is attached to the center of the front of the packaging pouch so as to extend from the upper end to the lower end of the packaging pouch (see Japanese Unexamined Patent Publication No. 10-258848). This being the case, the packaging pouch can be carried by not only holding in the hand but also by placing over the shoulder.

SUMMARY OF THE INVENTION

In general, information such as a product name, product usage instructions or product content are indicated on the front face or back face of a packaging pouch by printing thereon. However, since a carrying strap is attached from the upper end to the lower end of an outer package in Patent Document 1, there may be the risk of this information being concealed by the carrying strap.

In addition, since one end of the carrying strap is adhered to a sealing portion of the outer package, if a large tensile force acts on the carrying strap, there may be the risk of the sealing portion unintentionally coming apart. This problem is even more serious in the case the outer package is longitudinally long.

According to the present invention, a packaging pouch made of plastic film for packaging an absorbent article, in which a package formed by packaging an absorbent in the packaging pouch has a rectangular shape, wherein the packaging pouch being provided with a front face, a back face and a pair of side faces connected to the front face and the back face, and the side faces are folded towards the inside and arranged between the front face and the back face, wherein a sealing portion expanding in a transverse direction around the upper end of the packaging pouch, a side face portion that forms the side face of the package, and a top portion that forms the top face of the package by positioning between the sealing portion and the side face portion are formed, wherein perforations are further formed in the top portion along a reference line extending in the transverse direction from one side edge of the packaging pouch to the other side edge of the packaging pouch, and wherein handle members extending in the transverse direction from around one side edge of the packaging pouch to around the other side edge of the packaging pouch are respectively attached to the front face and back face positioned in the top portion below the perforations is provided.

The present invention may be more fully understood from the description of the preferred embodiments according to the invention as set forth below, together with the accompanying drawings.

DESCRIPTION OF THE PREFERRED EMBODIMENTS

Figure 1:
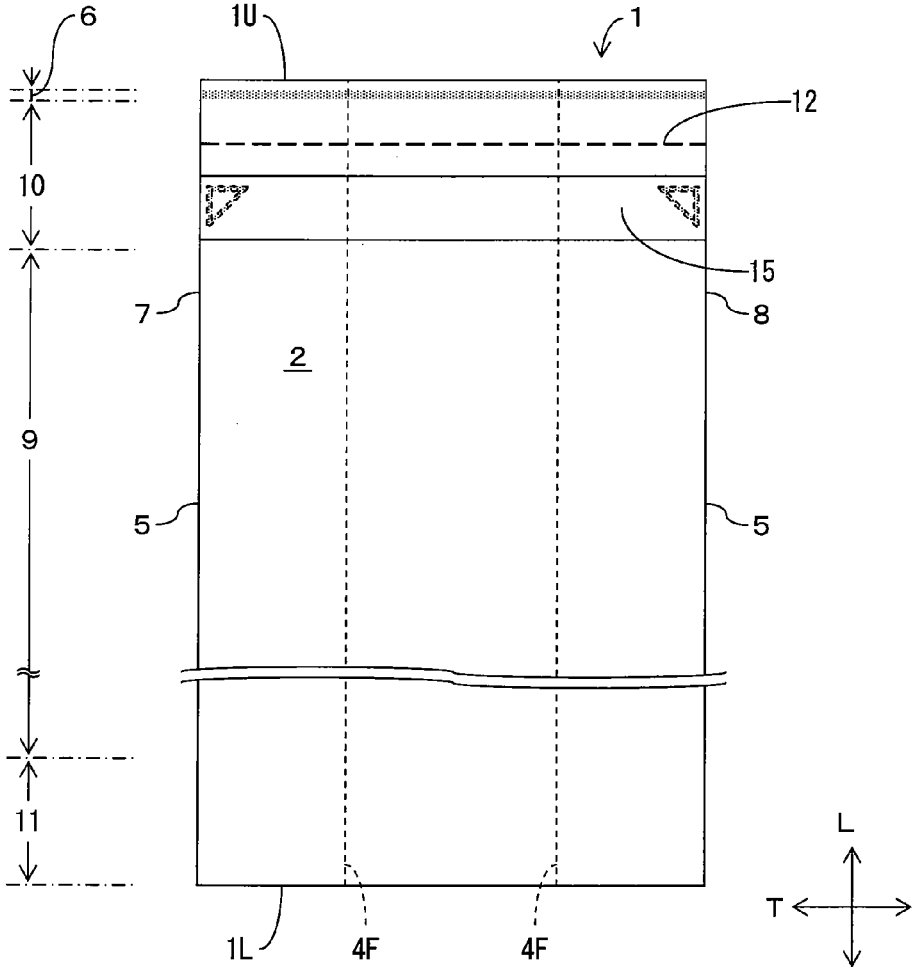
FIG. 1 is a plan view of a packaging pouch.
Figure 2:
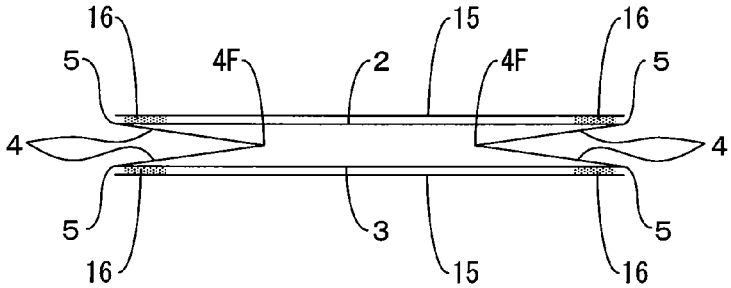
FIG. 2 is a bottom view of a packaging pouch.

With reference to FIGS. 1 and 2, a packaging pouch 1 for packaging an absorbent article has a long, narrow rectangular shape in a longitudinal direction L. The absorbent article includes, for example, a disposable diaper for use by a person or pet, a sanitary napkin or a urine absorbent pad.

The packaging pouch 1 is provided with a front face 2, a back face 3 and a pair of side faces 4. Each side face 4 is connected to the front face 2 and the back face 3 through a corresponding crease line 5 in the longitudinal direction L. Each side face 4 is folded towards the inside along crease lines 4F and 5F in the longitudinal direction L and is arranged between the front face 2 and the back face 3, thereby causing the packaging pouch 1 to have a flat shape. Note that the side faces 4 function as gussets.

A sealing portion 6 is formed around an upper end 1U of the packaging pouch 1, and this sealing portion 6 expands in a transverse direction T perpendicular to the longitudinal direction L. In the embodiment shown in FIG. 1, the sealing portion 6 is composed of a heat sealing portion extending from one side edge 7 to another side edge 8 of the packaging pouch 1. Namely, the front face 2, the back face 3 and the side faces 4 are integrally joined by the sealing portion 6, thereby air-impermeably sealing the upper edge of the packaging pouch 1. Note that a lower end 1L of the packaging pouch 1 is open.

Figure 3:
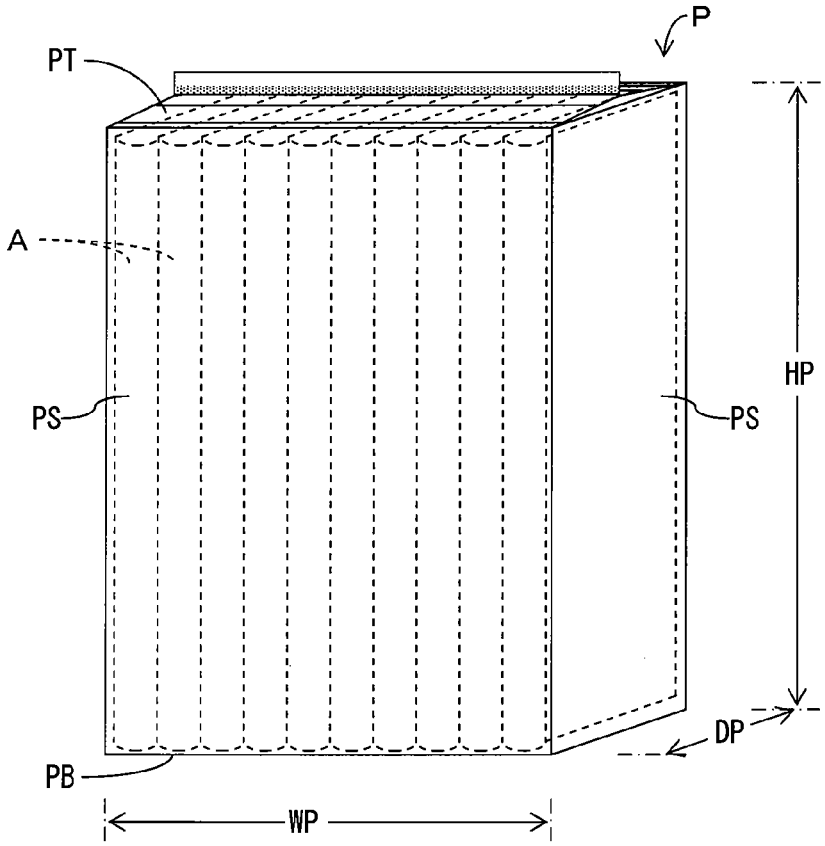
FIG. 3 is a perspective view of a package.
Figure 4:
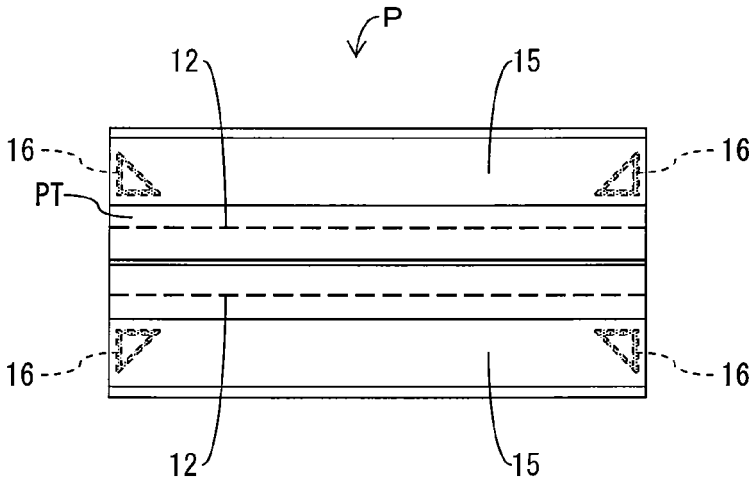
FIG. 4 is a top view of a package.

A plurality of absorbent articles A are housed within the packaging pouch 1 by passing through the open lower end 1L, after which the lower end 1L is sealed by, for example, heat sealing. As a result, a package P is formed as shown in FIGS. 3 and 4. The package P has a rectangular shape and has a top face PT, a bottom side PB and four side faces PS. In the embodiment shown in FIG. 3 in particular, the package P is longitudinally long. Namely, a height HP of the package P is greater than a width WP and a depth DP of the package P. In other words, the dimensions of the packaging pouch 1 are set so that the package P is longitudinally long.

In addition, the absorbent articles A are arranged in the transverse direction in the embodiment shown in FIG. 3. Note that the absorbent articles A may be housed in any manner in the packaging pouch 1.

With reference to FIG. 1 while referring to FIGS. 3 and 4, a tubular side face portion 9 that forms the side faces PS of the package P, a top portion 10 that forms the top face PT of the package P by positioning between the sealing portion 6 and the side portion 9, and a bottom portion 11 that forms the bottom side PB of the package P by positioning below the side face portion 9 are formed in the packaging pouch 1.

Perforations 12 are formed in the top portion 10. As shown in FIG. 1, the perforations 12 are formed along a reference line 13 extending in the transverse direction T from one side edge 7 to the other side edge 8 of the packaging pouch 1.

Figure 5:
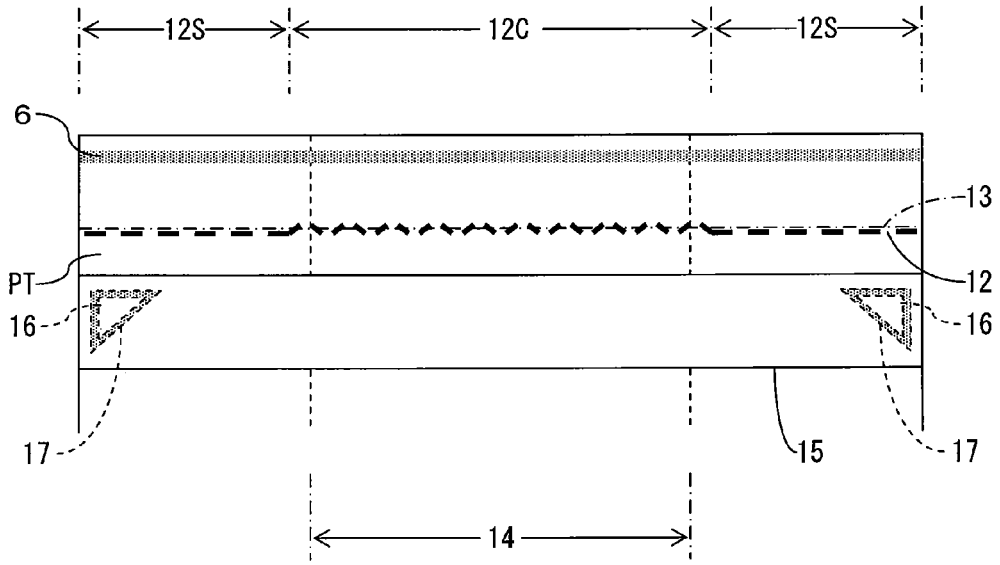
FIG. 5 is a partially enlarged view of a packaging pouch.

As shown in FIG. 5, cut portions in a central portion 12C of the perforations 12 extend so as to intersect the reference line 13 at alternately oppositely oriented angles. In contrast, cut portions in both side portions 12S of the perforations 12 positioned on both sides of the central portion 12C extend substantially parallel to the reference line 13. Here, if area where the side faces 4 do not overlap the front face 2 and the back face 3 is referred to as a non-overlapping area 14, then in the embodiment shown in FIG. 5, the width of the central portion 12C is greater than the width of the non-overlapping area 14. Alternatively, the width of the central portion 12C may also be substantially equal to or shorter than the width of the non-overlapping area 14.

Note that cut portions of the perforations 12 extend from the front face 2 to the back face 3 by passing through the side faces 4.

Moreover, handle members 15 extending in the transverse direction T from around one side edge 7 to the other side edge 8 of the packaging pouch 1 are respectively attached to the front face 2 and the back face 3 positioned in the top portion 10 below the perforations 12.

Each handle member 15 has a long, narrow band-like shape in the transverse direction T, and is attached to the front face 2 and the back face 3, respectively, by means of a pair of attachment areas 16 provided around one side edge 7 and the other side edge 8, respectively, of the packaging pouch 1. In addition, in the embodiment shown in FIG. 5, each attachment area 16 is in the shape of a right triangle, and includes an inclined portion 17 extending to both sides from the center of the packaging pouch 1 as it faces downward. These inclined portions 17 are inclined at an angle of, for example, about 45 degrees relative to the longitudinal direction L and the transverse direction T, respectively.

The attachment areas 16 can be composed of heat sealing portions, for example. In this case, the heat sealing portions are respectively formed between the handle member 15 and the front face 2 and between the handle member 15 and the back face 3. Note that the corners of the attachment areas 16 may be rounded.

The packaging pouch 1 is composed of a plastic film. A blend of linear low-density polyethylene and low-density polyethylene, polypropylene or high-density polyethylene and the like can be used for the plastic. Note that the pouch body composed of the front face 2, the back face 3 and the side faces 4 may be composed of the same material as the handle members 15 or may be composed of mutually different materials.

Figure 6:
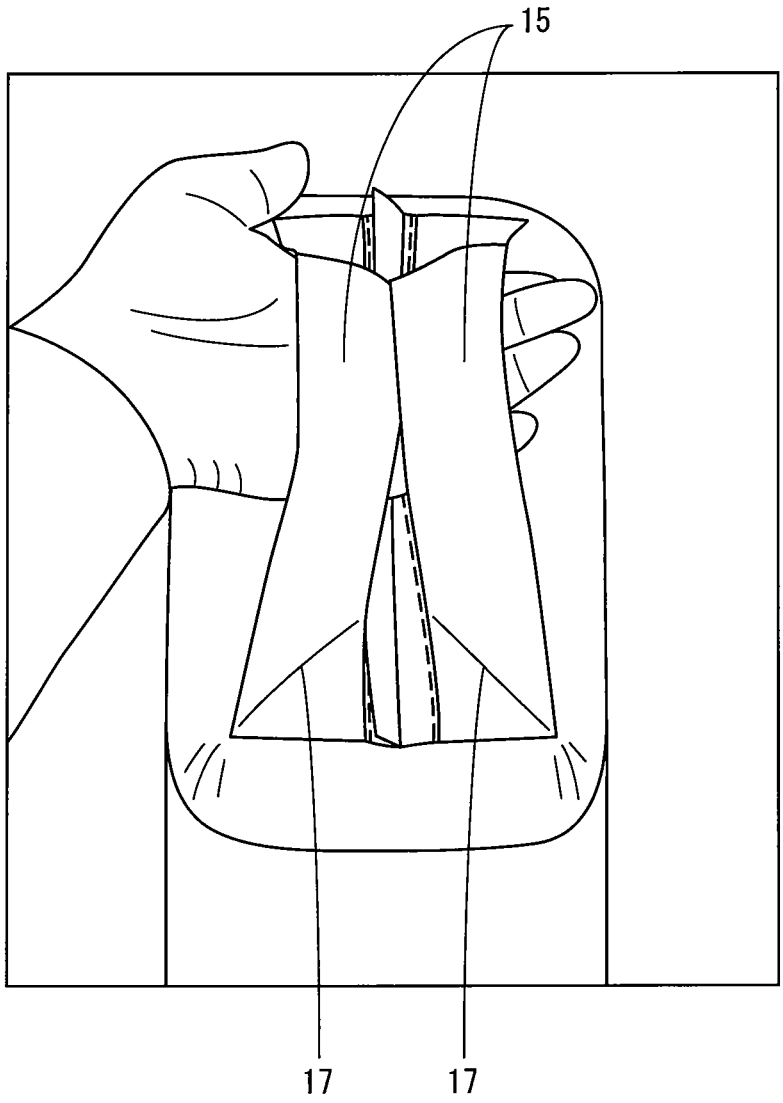
FIG. 6 is a drawing for explaining the manner in which a packaging pouch is used before opening.

As was previously described, the package P having a rectangular shape is formed by housing the absorbent articles A in the packaging pouch 1. The pair of handle members 15 is provided on the top face PT of this package P. As a result, as shown in FIG. 6, a user is able to easily carry the package P by placing a hand or arm around these handle members 15.

In this case, the handle members 15 are not present on the side faces PS of the package P, thereby preventing concealment of information on the side faces PS.

In addition, since the handle members 15 do not overlap the sealing portion 6 and the perforations 12, unintentional opening of the package pouch 1 when carrying is prevented. Moreover, since the cut portions of the central portion 12C of the perforations 12 extend so as to intersect the reference line 13 at alternately oppositely oriented angles, unintentional opening of the packaging pouch 1 is prevented even more reliably.

Moreover, since the attachment areas 16 have inclined portions 17, the handle members 15 easily become parallel to the surface of a hand or arm when a hand or arm is placed around the handle members 15. Thus, since the handle members 15 are able to make contact with a user over a wide surface area, the user is able to easily carry the package P. Namely, in the case of, for example, finger holes formed by stamping out portions of the packaging pouch 1, since the packaging pouch only makes slight contact with the user around the finger holes, there may be a risk of pain to the user.

Figure 7:
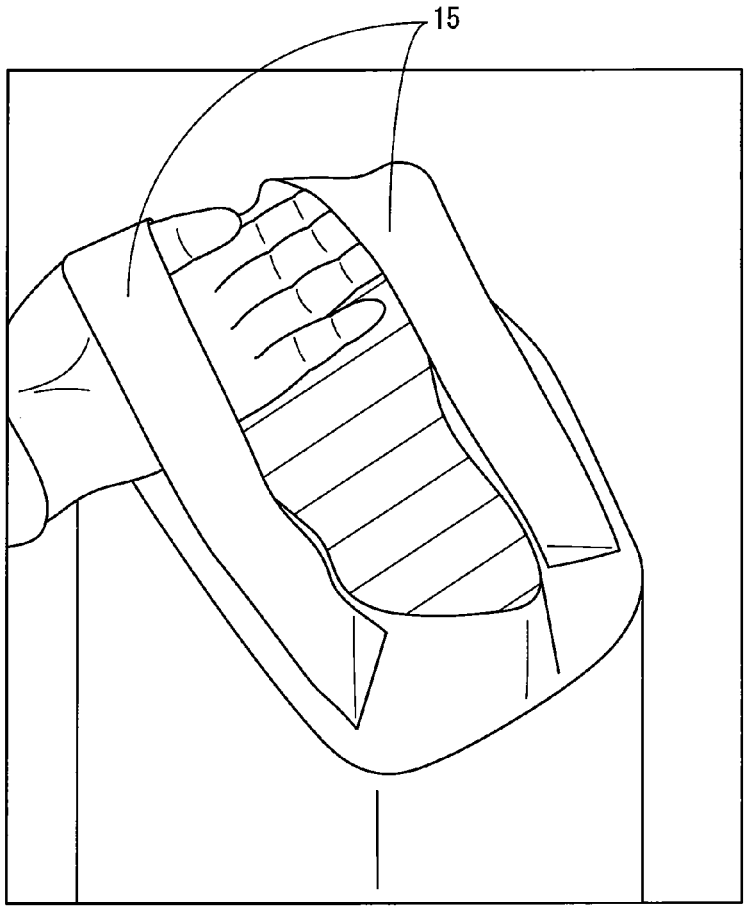
FIG. 7 is a drawing for explaining the manner in which a packaging pouch is used after opening.

On the other hand, when the absorbent article A is to be taken out of the package P, the packaging pouch 1 is opened by tearing along the perforations 12. As a result, as shown in FIG. 7, an opening is formed in the packaging pouch 1. This opening is as large as the transverse cross-sectional area of the package P, therefore enabling the absorbent article A to be easily removed from the packaging pouch 1. In this case, the packaging pouch 1 can be opened easily without having to use scissors, etc..

Moreover, the packaging pouch 1 is able to maintain the shape of a pouch after having been opened. Thus, the packaging pouch 1 can be easily reused as a refuse bag, for example.

In addition, a user is able to easily carry the package P by placing a hand or arm around the handle members 15 even after opening. This approach is not present in the prior art.

Figure 8:
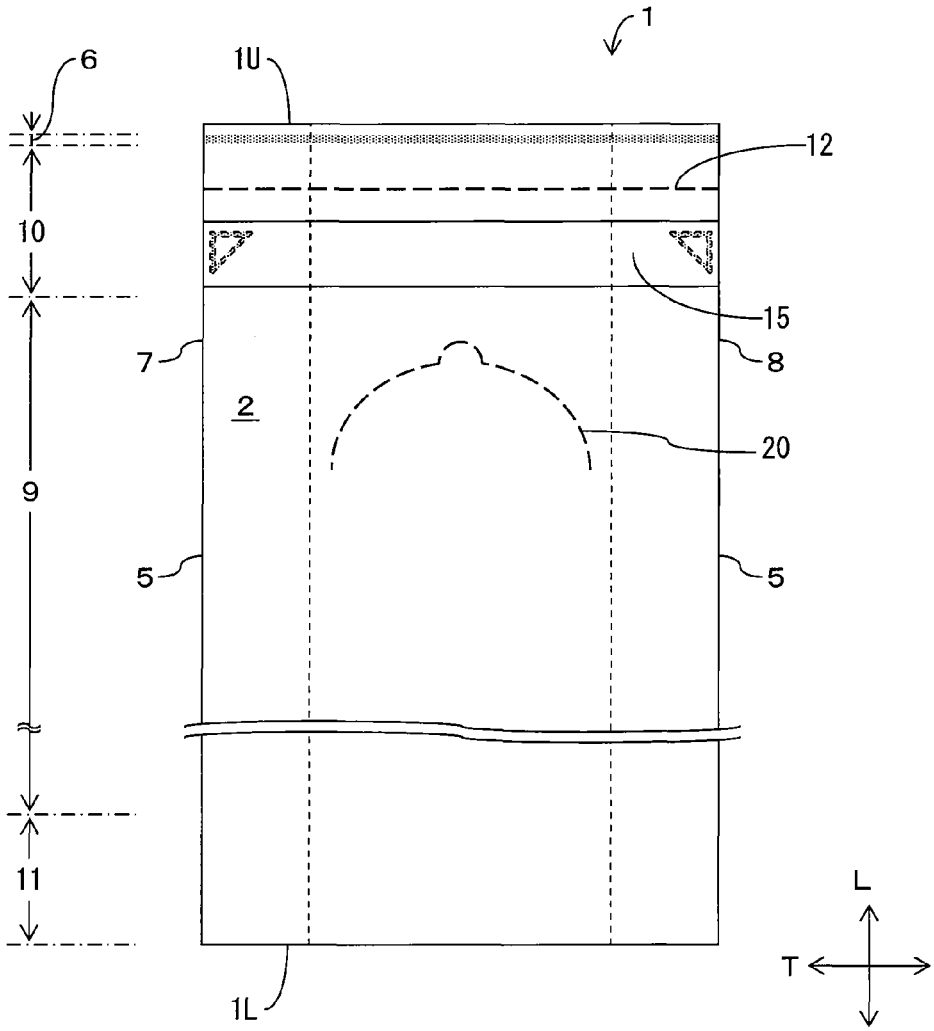
FIG. 8 is a plan view of a packaging pouch showing additional perforations.
Figure 9:
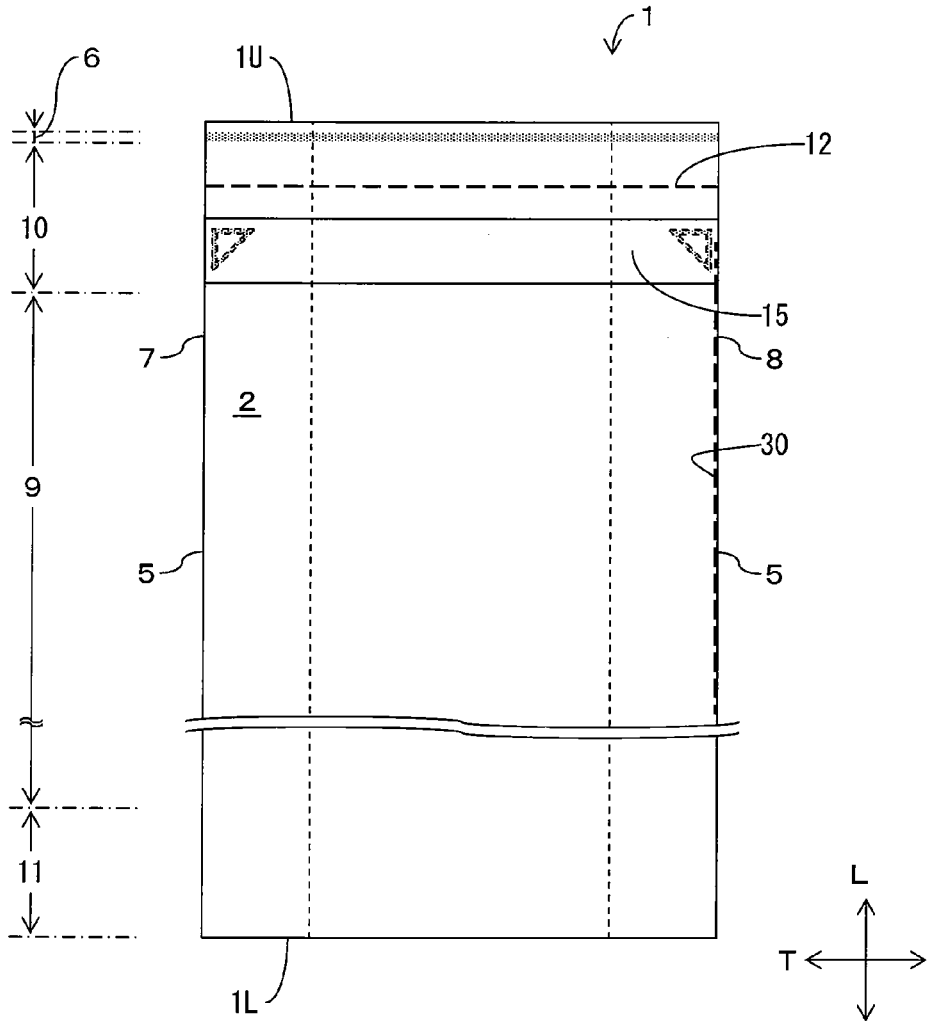
FIG. 9 is a plan view of a packaging pouch showing other additional perforations.

As shown in FIGS. 8 and 9, additional perforations can also be provided in the packaging pouch 1. In the embodiment shown in FIG. 8, additional perforations 20 are provided in the front face 2. These additional perforations 20 have, for example, an upward-facing convex shape. When the additional perforations 20 are torn apart, an opening is formed that is sufficiently large for removing at least one absorbent article A. Namely, the absorbent article A can be removed without tearing the perforations 12. Note that the additional perforations 20 may also be provided only in the back face 3 or in both the front face 2 and the back face 3.

In the embodiment shown in FIG. 9, additional perforations 30 are provided along the crease line 5 between the front face 2 and the side face 4. These additional perforations 30 extend, for example, over substantially half of the top portion 10 and substantially ¾ of the side face portion 9. In the embodiment shown in FIG. 9 as well, an opening is formed that is sufficiently large for removing at least one absorbent article A when the additional perforations 30 are torn open. Namely, the absorbent article A can be removed without tearing the perforations 12. Note that the additional perforations 30 may also be provided at a plurality of locations. Alternatively, both of the additional perforations 20 and 30 shown in FIGS. 8 and 9 can also be provided.

In each of the embodiments described thus far, the dimensions of the packaging pouch 1 are set so that the package P is longitudinally long. However, the dimensions of the packaging pouch 1 can also be set so that the package P has a horizontally long rectangular shape or cubic shape.

In addition, in each of the embodiments described thus far, the heat sealing portions that compose the attachment areas 16 are respectively formed between the handle members 15 and the front face 2 and back face 3. Namely, the attachment areas 16 are separated from the side faces 4. In other words, the handle members 15 are respectively attached only to the single sheet portion consisting of the front face 2 and to the single sheet portion consisting of the back face 3. Consequently, a large opening is formed when the packaging pouch 1 is torn open along the perforations 12.

Figure 10:
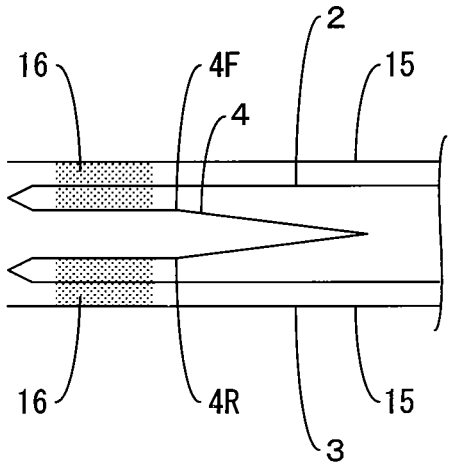
FIG. 10 is a bottom view of a packaging pouch of another embodiment according to the present invention.

In contrast, as shown in FIG. 10, the heat sealing portions that compose the attachment areas 16 may be respectively formed between the handle member 15, the front face 2 and a portion 4F of the side face 4 overlapping the front face 2, and between the handle member 15, the back face 3 and a portion 4R of the side face 4 overlapping the back face 3. Namely, in this case, the handle members 15 are respectively attached to two sheet portions consisting of the front face 2 and the side face 4 and two sheet portions consisting of the back face 3 and the side face 4.

This being the case, the handle members 15 can be securely attached to the packaging pouch 1. As a result, the thickness of the plastic film that composes the packaging pouch 1 can be reduced, thereby making it possible to decrease manufacturing costs of the packaging pouch 1.

In addition, when a user lifts up the package P by placing a hand around the handle members 15, the front face 2 and the back face 3 are inhibited from shifting with respect to the side faces 4. As a result, information on the side faces PS of the package P is inhibited from being distorted, thereby enabling a user to reliably read that information. Namely, when the attachment areas 16 are separated from the side faces 4, there may be the risk of the front face 2 and the back face 3 shifting with respect to the side faces 4 when the package P is picked up, and in this case, information on the side faces PS is distorted and is difficult to read. In the embodiment shown in FIG. 10, this type of distortion is inhibited.

Figure 11:
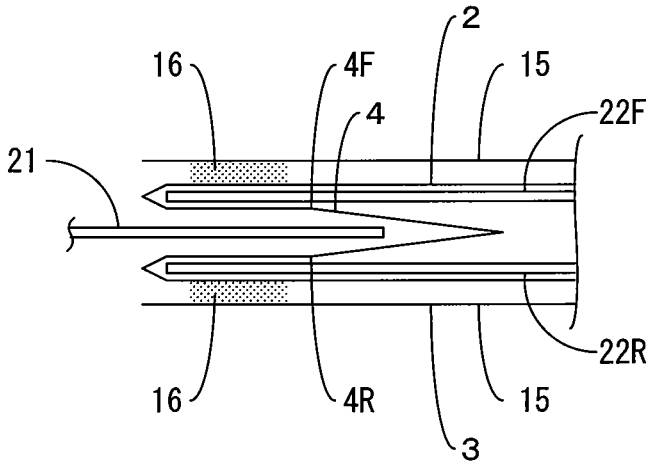
FIG. 11 is a schematic diagram showing a method of forming attachment areas in the case of attaching a handle member to single sheet portions.

FIG. 11 shows a method of forming the attachment areas 16 in the case the handle members 15 are attached to the single sheet portion. In this case, a shielding plate 21 capable of shielding heat is arranged between the portions 4F and 4R of the side faces 4, a shielding plate 22F is arranged between the front face 2 and the portion 4F, and a shielding plate 22R is arranged between the back face 3 and the portion 4R. Next, the handle members 15 are respectively attached by heat sealing only to the front face 2 and only to the back face 3. Note that the heat shielding plate 21 can also be omitted.

Figure 12:
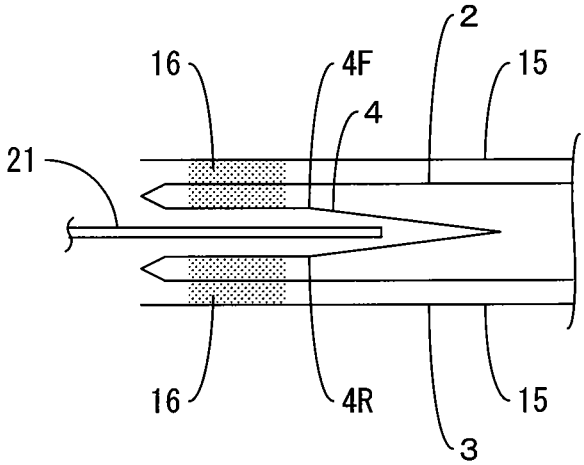
FIG. 12 is a schematic diagram showing a method of forming attachment areas in which of attaching a handle member to two sheet portions.

FIG. 12 shows a method of forming the attachment areas 16 in the case the handle members 15 are attached to two sheet portions. In this case, the heat shielding plate 21 is arranged between the portions 4F and 4R of the side faces 4 without arranging the shielding plate 22F and the shielding plate 22R between the front face 2 and the portion 4F and between the back face 3 and the portion 4R. Next, the handle members 15 are respectively attached by heat sealing to the portion 4F of the front face 2 and the portion 4F of the back face 3.

Furthermore, each of the previously described embodiments according to the present invention can also be mutually combined.

According to the present invention, a package can be carried easily without concealing information provided on a packaging pouch while inhibiting unintentional opening of the packaging pouch.

While the invention has been described by reference to specific embodiments chosen for purposes of illustration, it should be apparent that numerous modifications could be made thereto, by those skilled in the art, without departing from the basic concept and scope of the invention.

The present application claims the benefit of JP patent Application No. 2011-152166, the entire disclosure of which is incorporated by reference herein.

The invention claimed is:

1. A packaging pouch made of plastic film for packaging an absorbent article, in which a package formed by packaging an absorbent in the packaging pouch has a rectangular shape, wherein the packaging pouch being provided with a front face, a back face and a pair of side faces connected to the front face and the back face, and the side faces are folded towards the inside and arranged between the front face and the back face, wherein a sealing portion expanding in a transverse direction around the upper end of the packaging pouch, a side face portion that forms the side face of the package, and a top portion that forms the top face of the package by positioning between the sealing portion and the side face portion are formed, wherein perforations are further formed in the top portion along a reference line extending in the transverse direction from one side edge of the packaging pouch to the other side edge of the packaging pouch, and wherein handle members extending in the transverse direction from around one side edge of the packaging pouch to around the other side edge of the packaging pouch are respectively attached to the front face and back face positioned in the top portion below the perforations, wherein each of the handle members, the front face and the back face are respectively and mutually attached by means of a pair of attachment areas, and each attachment area includes an inclined portion extending from the center to both sides of the packaging pouch as it faces downward.

2. The packaging pouch according to claim 1, wherein the rectangular shape of the packaging pouch has a longer dimension in a longitudinal direction.

3. The packaging pouch according to claim 1, wherein the attachment areas are composed of heat sealing portions, and the heat sealing portions are respectively formed between a handle member, the front face and a portion of a side face overlapping the front face, and between a handle member, the back face and a portion of a side face overlapping the back face.

4. The packaging pouch according to claim 1, wherein cut portions of a central portion of the perforations extend so as to intersect the reference line at alternately oppositely oriented angles.

5. The packaging pouch according to claim 1, wherein said perforations have side portions and wherein cut portions of said side portions extend substantially parallel to the reference line.

6. A packaging pouch made of plastic film for packaging an absorbent article, in which a package formed by packaging an absorbent in the packaging pouch has a rectangular shape, wherein the packaging pouch being provided with a front face, a back face and a pair of side faces connected to the front face and the back face, and the side faces are folded towards the inside and arranged between the front face and the back face, wherein a sealing portion expanding in a transverse direction around the upper end of the packaging pouch, a side face portion that forms the side face of the package, and a top portion that forms the top face of the package by positioning between the sealing portion and the side face portion are formed, wherein perforations are further formed in the top portion along a reference line extending in the transverse direction from one side edge of the packaging pouch to the other side edge of the packaging pouch, and wherein handle members extending in the transverse direction from around one side edge of the packaging pouch to around the other side edge of the packaging pouch are respectively attached to the front face and back face positioned in the top portion below the perforations, wherein cut portions of a central portion of the perforations extend so as to intersect the reference line at alternately oppositely oriented angles.

7. The packaging pouch according to claim 6, wherein each of the handle members, the front face and the back face are respectively and mutually attached by means of a pair of attachment areas, and each attachment area includes an inclined portion extending from the center to both sides of the packaging pouch as it faces downward.

8. The packaging pouch according to claim 7, wherein the attachment areas are composed of heat sealing portions, and the heat sealing portions are respectively formed between a handle member, the front face and a portion of a side face overlapping the front face, and between a handle member, the back face and a portion of a side face overlapping the back face.

9. The packaging pouch according to claim 6, wherein the rectangular shape of the packaging pouch has a longer dimension in a longitudinal direction.

10. The packaging pouch according to claim 6, wherein said perforations have side portions and wherein cut portions of said side portions cut portions on of both side portions of the perforations extend substantially parallel to the reference line.

* * * * *